United States Patent [19]

Blow, Jr. et al.

[11] 4,054,205

[45] Oct. 18, 1977

[54] COMBINATION PRODUCT CONTAINER AND ATTACHMENT FOR BEVERAGE CANS

[76] Inventors: James H. Blow, Jr., 23 Palisade Ave., Piscataway, N.J. 08854; Louis C. Blow, 115 Lincoln St., Tallahassee, Fla. 32301

[21] Appl. No.: 698,369

[22] Filed: June 22, 1976

[51] Int. Cl.[2] ..... B65D 77/24; B65D 25/00; B65D 35/38

[52] U.S. Cl. ..... 206/217; 222/553; 222/570; 426/115; 220/85 SP

[58] Field of Search ..... 206/217, 216; 220/90.2, 220/90.4, 90.6, 85 R, 85 SP; 222/567, 570, 461, 553, 555; 426/115, 120

[56] References Cited

U.S. PATENT DOCUMENTS

| | | | |
|---|---|---|---|
| 1,430,552 | 10/1911 | Hothersall | 222/570 |
| 1,879,517 | 9/1932 | Rowbotham | 220/85 R |
| 2,559,362 | 7/1951 | Langfeld | 220/90.2 |
| 2,766,796 | 10/1956 | Tupper | 206/217 |
| 3,895,743 | 7/1975 | Christian | 222/570 |

FOREIGN PATENT DOCUMENTS

| | | | |
|---|---|---|---|
| 604,387 | 5/1960 | Italy | 220/855 P |
| 865,259 | 4/1961 | United Kingdom | 220/90.2 |

*Primary Examiner*—William Price
*Assistant Examiner*—Douglas B. Farrow

[57] ABSTRACT

The bottom portion of a cupshaped vessel adapted to fit snugly over the rim of a conventional beverge can is provided with a selectively slotted opening preferably bounded by a sealing rib, the opening being contoured to approximate the usual pull-tab opening in the beverage can to provide a drinking attachment therefor. A second sealing rib may be provided to reseal the opening of the beverage can for storage and transport upon the rotation of the drinking attachment from a first or drinking position to a second or sealing position. The vessel may be provided with a lid portion to serve as a product container the contents of which may be emptied and the vessel thereafter used as a drinking attachment.

7 Claims, 12 Drawing Figures

COMBINATION PRODUCT CONTAINER AND ATTACHMENT FOR BEVERAGE CANS

BACKGROUND OF THE INVENTION

1. Field of the Invention

The invention is directed to the field of containers and principally to a drinking attachment for beverage cans or the like.

2. Description of the Prior Art

Drinking and pouring spouts in accordance with the prior art have been designed for attachment to beverage cans. For example, a segmented drinking or pouring spout for use with beverage cans is shown in U.S. Pat. No. 3,197,089 issued to H. G. Michael on July 27, 1965; and in U.S. Pat. No. 3,229,868 issued to C. C. Bayne on Jan. 18, 1966. These devices are designed primarily to protect the mouth of the user from direct contact with the can rim and provide only a partial enclosure about the opening in the can top. Furthermore, no means are provided for selectively sealing the can opening to prevent inadvertent leakage during use and transport. An enclosed drinking attachment for beverage container is shown in U.S. Pat. No. 2,725,732 issued to J. Somoga on Dec. 6, 1955. This device, although avoiding some of the shortcomings of the former devices, still fails to provide any means for sealing the beverage can for future use in the event the contents thereof are only partially consumed. Without a convenient means for releasably sealing the can opening, the user would be required to maintain the can in an upright position during storage and transport to prevent leakage of the contents therefrom.

SUMMARY OF THE INVENTION

The invention overcomes the limitations and difficulties noted above with respect to prior art devices by providing a drinking attachment for beverage cans which is more convenient, versatile, and more adaptable than such prior art devices. The attachment comprises a cup-shaped vessel having an annular recess circumventing its bottom portion for snugly receiving the rim of a beverage can. A slotted opening extending radially outwardly from the center of the bottom portion is specially configured to conform generally to the shape of the opening provided in the lid of the beverage can having a pull-tab opening. Thus, the attachment may be placed atop the beverage can and oriented in such manner as to align the attachment opening with the can opening to permit the contents of the can to enter the vessel and be consumed by the user. The attachment opening may be bounded on its underside by a rib portion adapted to seal about the can opening to direct the contents of the can into the vessel. A further rib portion similar to the first mentioned rib portion and angularly displaced therefrom may be provided to seal the can opening as the attachment is axially rotated into the sealing position about the rim of the beverage can. Variously contoured openings may be provided in the bottom portion of the attachment to conform generally to one or more of the beverage can pull-tab openings generally encountered in use. The vessel may also be provided with a removable sealing element covering the bottom portion opening to provide a convenient product container which may subsequently be employed as a drinking attachment. It is therefore an object of this invention to provide an improved drinking attachment for a beverage can or the like.

It is another object of this invention to provide a combination product container and drinking attachment for a beverage can.

It is a further object of this invention to protect the mouth of the user from direct contact with the rim of a beverage can during the consumption of the contents therefrom.

It is still another object of this invention to permit partial consumption of the contents of a beverage can while avoiding leakage or spillage of the remaining contents during storage and transport.

It is yet another object of this invention to provide a reusable drinking attachment for a beverage can.

It is still a further object of this invention to provide a drinking attachment for a beverage can, which attachment is so constructed as to be rotatable about the rim of the can to provide a drinking position and a sealing position.

It is yet a further object of this invention to provide a universally adaptable beverage can drinking attachment.

It is still another object of this invention to provide a combination product container and drinking attachment for a beverage can whereby the user may simultaneously consume the contents of both the product container and the beverage can.

Other objects and features of the invention will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
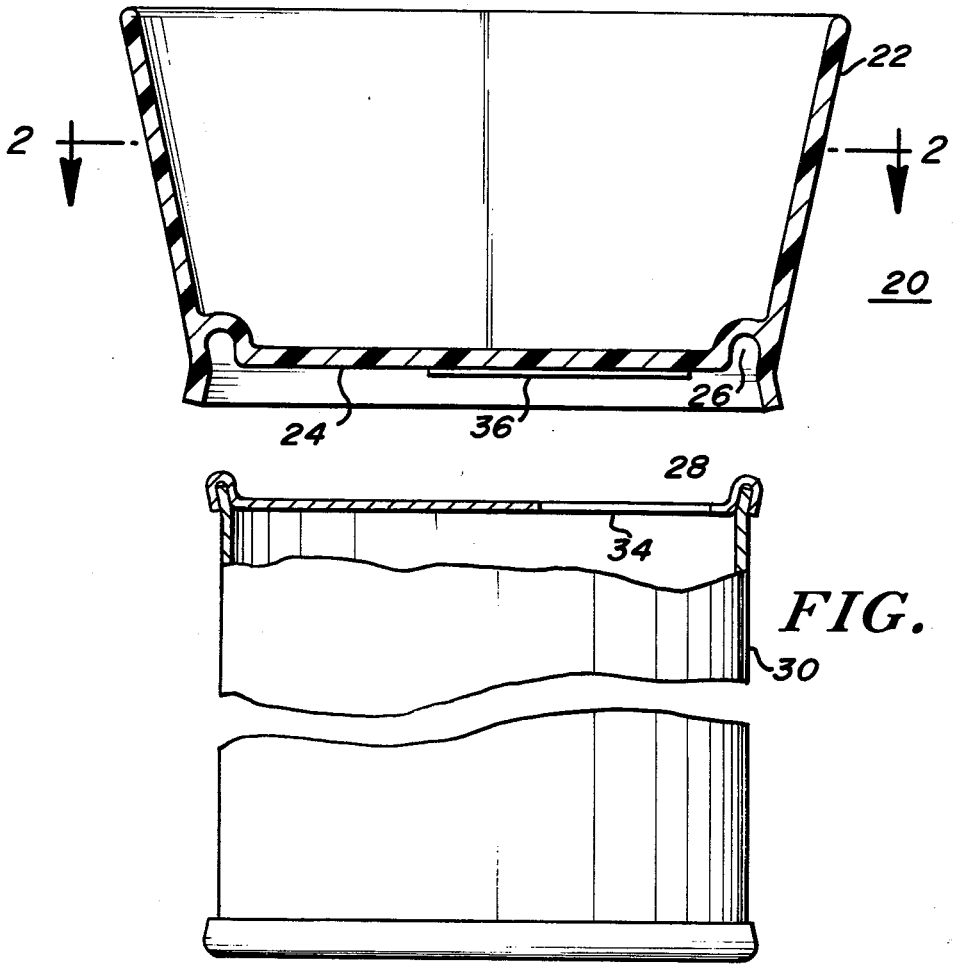
FIG. 1 is a side elevational view partly in section, showing a drinking attachment constructed in accordance with the concepts of the invention.
Figure 2:
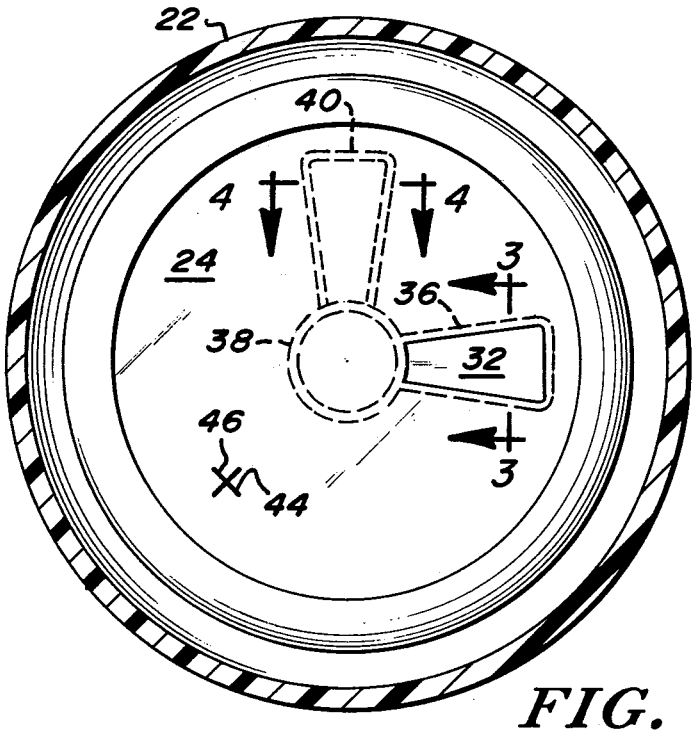
FIG. 2 is a top plan view partly in section, taken along the line 2—2 of FIG. 1.
Figure 3:
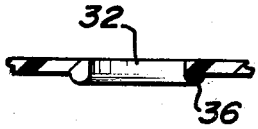
FIG. 3 is a sectional view taken along the line 3—3 of FIG. 2.
Figure 4:
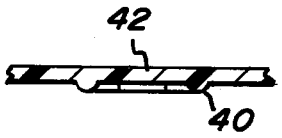
FIG. 4 is a sectional view taken along the line 4—4 of FIG. 2.
Figure 12:
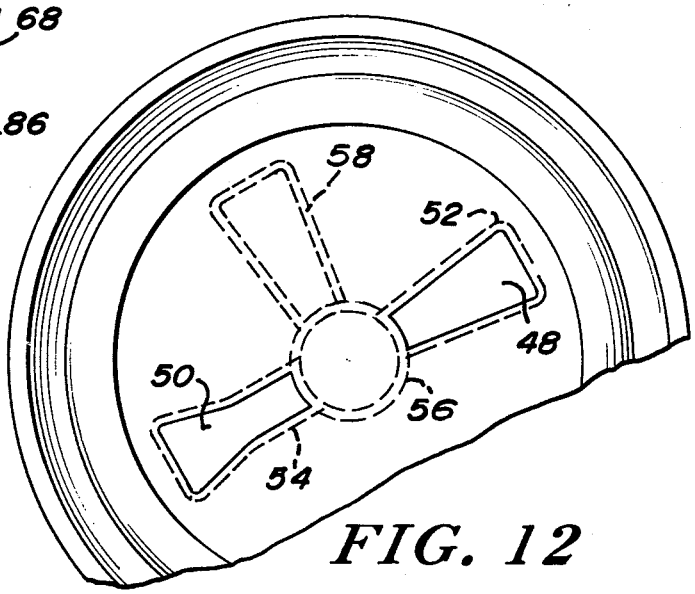
FIG. 12 is a fragmentary top plan view of a further embodiment of the bottom portion of a drinking attachment for a beverage can in accordance with the concepts of the invention.

Turning now to FIGS. 1 through 8 there is shown a drinking attachment 20 constructed in accordance with the concepts of the invention and comprising an annular cup shaped vessel which may be conveniently molded from suitable plastic material and having sidewalls 22 and a bottom portion 24. An annular recess 26 bounding the bottom portion 24 is adapted to snugly receive the rim portion 28 of a container such as a beverage can 30. As shown in greater detail in FIG. 2, the bottom portion 24 is generally planar and comprises a radially extending slotted opening 32 which is contoured to approximate the shape of a pull tab opening 34 (FIG. 5) in the beverage can 30. The opening 32 in the bottom portion 24 is bounded by a rib portion 36 which includes an arcuate segment 38 located generally about the radial center of the bottom portion 24, the rib portion 36, and segment 38 being located adjacent the underside of the attachment 20. A sealing means shown as a second rib portion 40 having a contour preferably similar to the contour of the rib portion 36 is angularly displaced from the rib portion 36 and also includes a portion of the arcuate segment 38 which provides a continuous contour between the rib portions 36 and 40. As shown in FIG. 4, the rib portion 40 is located adjacent a totally enclosed area 42 of the bottom portion 24. Angularly displaced from both the first and second rib portions 36 and 40, respectively, are a pair of slits 44 and 46 arranged generally in a cruciform pattern whereby a drinking straw or similar elongate tubular element may be inserted therethrough as an alternative means for consuming the contents of the beverage can. Although only one specially contoured opening 32 in the bottom portion 24 is shown in FIG. 2, a plurality shown by way of example as two such openings 48 and 50 in FIG. 12 may be provided, to more closely approximate a particular pull-tab type opening in the lid of a beverage can. Each of the openings 48 and 50 is bounded by a rib portion 52, 54, respectively, similar to the rib portions 52 and 54 sharing a common arcuate rib segment 56 in a manner similar to that described above with respect to segment 38. Intermediate the two openings 48 and 50 is a further rib portion 58 essentially duplicative of portion 40 and functioning in a similar manner for sealing the beverage can opening 34. The arcuate rib segment 56 is also contiguous with the rib portion 58 and thus provides a continuous rib contour comprising the rib portions 52, 54, 58, and the arcuate segment 56.

Figure 5:
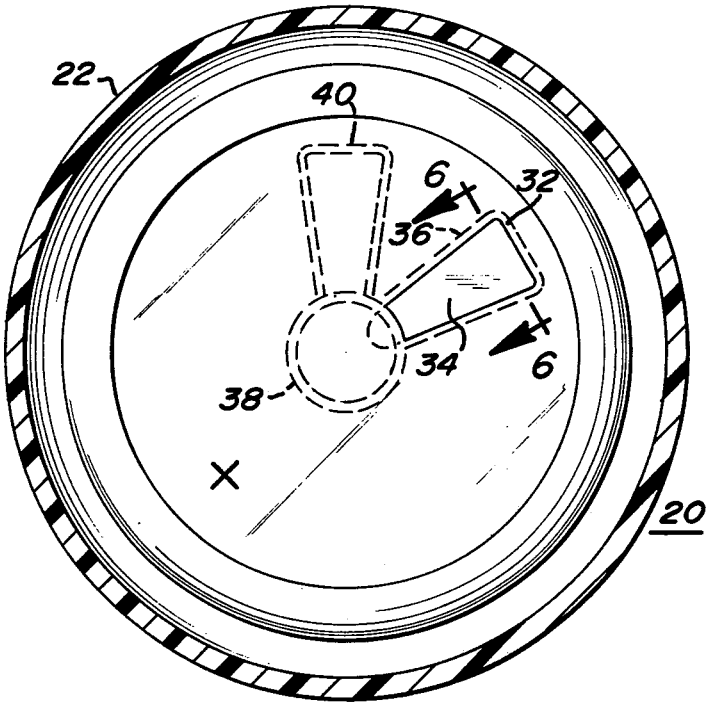
FIG. 5 is a top plan view, partly in section, showing the bottom portion of the device of FIG. 1 disposed over the top of a beverage can in a drinking position.
Figure 6:
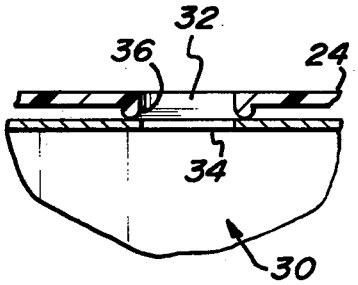
FIG. 6 is a fragmentary side elevational view, partly in section, taken along the line 6—6 of FIG. 5.
Figure 7:
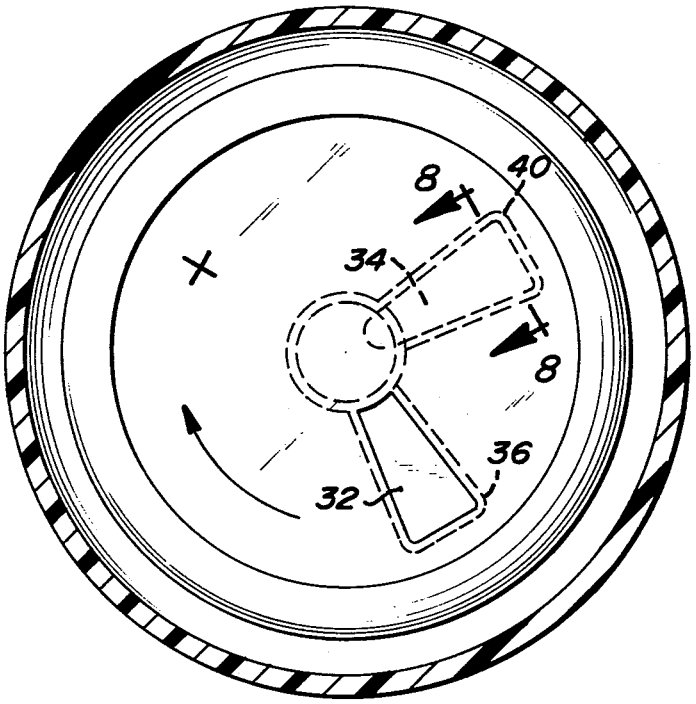
FIG. 7 is a top plan view, similar to FIG. 5, showing the bottom portion of the device of FIG. 1 disposed over the top of a beverage can in a sealing position .
Figure 8:
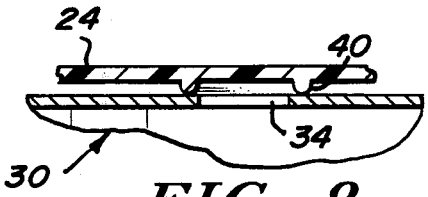
FIG. 8 is a fragmentary side elevational view, partly in section, taken along the line 8—8 of FIG. 7.

In FIG. 5 the drinking attachment 20 is shown selectively positioned atop the beverage can 30 of which only the beverage can opening 34 thereof is visible. The recess 26 of the attachment 20 is engaged with the rim 28 of the beverage can 30 and the attachment 20 oriented in such manner as to align the opening 32 in the bottom portion 24 of the attachment 20 with the opening 34 in the can 30 as shown in greater detail in FIG. 6. In FIG. 6 it will be seen that the rib portion 36 is disposed in intimate contact with the surface of the lid of the can 30 just outwardly of the opening 34. Thus, the rib portion 36 surrounds the opening 34 and provides a seal thereabout, insuring that the contents of the can 30 will be directed solely into the opening 32 of the bottom portion 24 where such contents may be received within the attachment 20 and consumed therefrom. In the event either all or a portion of the contents of the can 30 is consumed and the can 30 is to be discarded, the attachment 20 may then be snapped off the rim 28, the can 30 discarded, and the attachment 20 retained for future use. However, where a portion of the contents of the container 30 is consumed and it is desired to retain the remainder for future consumption, the attachment 20 is simply suitably rotated on the rim 28 of the can 30 until the rib portion 40 is selectively oriented on the lid of the can 30 so as to surround the can opening 34, as shown in FIGS. 7 and 8, providing a complete seal thereabout. The opening 32 in the bottom portion 24 is simultaneously angularly displaced away from the can opening 34 and is seated over an unapertured area of the lid of the can 30 so that the possibility of any of the contents of the can 30 entering the opening 32 is eliminated. Thus, the can 30 with the attachment 20 in place as shown in FIG. 7 may be readily stored or transported in any desired position while the contents thereof are safely retained within the can 30. If access to the remainder of the contents of the can 30 is thereafter desired, the attachment 20 is simply rotated back to the position shown in FIG. 5 in which the attachment bottom portion opening 32 is again aligned with the can opening 34. This procedure may, of course, be repeated indefinitely until the contents of the can 30 are completely consumed.

Figure 9:
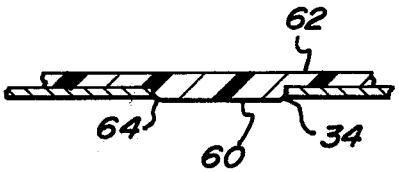
FIG. 9 is a fragmentary side elevational view, in section, showing a further embodiment of the sealing means of a drinking attachment constructed in accordance with the concepts of the invention.

Referring now to FIG. 9, there is shown an alternative embodiment of a sealing means 60 located adjacent the undersurface of a bottom portion 62 of a drinking attachment constructed in accordance with the concepts of the invention. The sealing means 60, instead of comprising a relatively narrow rib portion such as element 40, comprises a thickened section contiguous with the bottom portion 62 and having an outer or peripheral contour 64 corresponding generally to the contour of the rib portion 40, but of slightly reduced size so as to fit tightly within the can opening 34 and provide a seal thereat when the drinking attachment is suitably oriented on the can lid.

Figure 10:
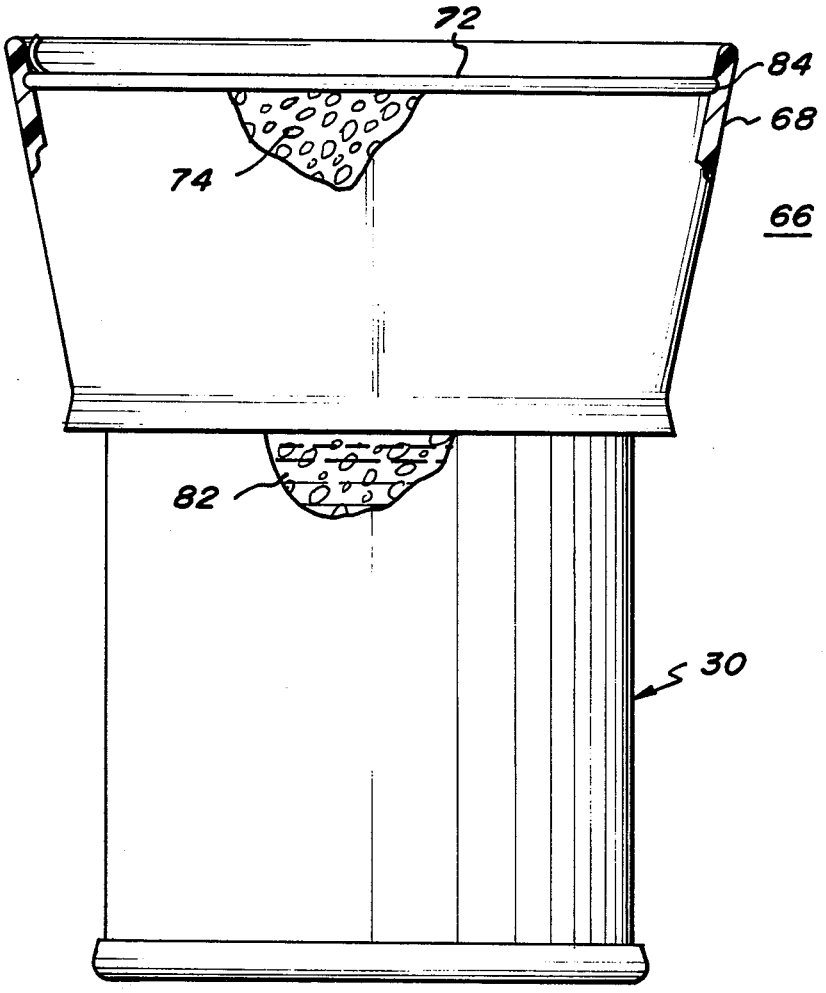
FIG. 10 is a side elevational view, partly cut away and partly in section, showing a combination product container and drinking attachment constructed in accordance with the concepts of the invention and seated atop a beverage can.
Figure 11:
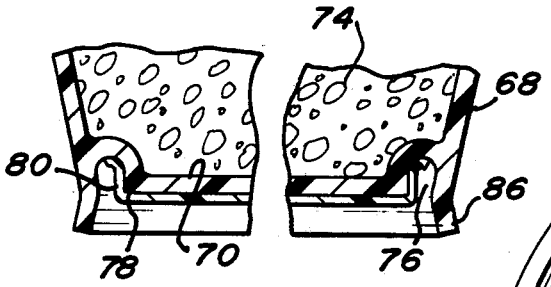
FIG. 11 is a fragmentary sectional view showing details of the bottom portion of the device of FIG. 10.

Referring now to FIGS. 10 and 11, the drinking attachment 20 shown in FIG. 1 may be modified somewhat to provide a combination product container and drinking attachment 66 which as shown in FIG. 10, may be similarly snapped in place atop the beverage can 30. The device 66 is constructed with sidewalls 68 and a bottom portion 70 (FIG. 11) essentially similar to elements 22 and 24, respectively, but further includes a lid 72 wedgingly received within the sidewalls 68 for containing any suitable food product 74. For example, the product 74 may comprise any desert-like preparation such as ice cream, fruit segments, puddings, pie, or one or more combinations thereof. The bottom portion 70 includes one or more openings such as 32, not shown, and a sealing means such as the rib portion 40 (not shown), the bottom portion 70 further including an annular recess 76 similar to recess 26 for receiving the rim 28 of the beverage can 30. A conveniently removable sealing element 78 which may comprise an annular plastic element having a lip portion so arranged to bear against the inner surface of the recess 76 is provided to at least temporarily seal any openings in the bottom portion 70 while the product 74 is contained therewithin. The sealing element 78 may be readily removed from the bottom portion 70 simply by pulling the element away from the bottom portion until the lip portion 80 is disengaged from the recess 76. The openings in the bottom portion 70 are then fully exposed for use as described above with respect to the embodiments shown in FIGS. 1 through 8. It should be appreciated that the sealing element 78 may be replaced adjacent the bottom portion 70 after the contents of the part 66 have been removed either by consumption or otherwise and the part 66 thereafter reused either as an independent drinking vessel or as a drinking attachment in conjunction with the beverage can 30. It will also be appreciated that the sealing element 78 may be removed from the part 66 while the product 74 is still contained therewithin, in which case the part 66 may be snapped in place atop the beverage can 30 and suitably aligned therewith so that the opening in the bottom portion 70 coincides with the pull-tab opening in the lid of the beverage can 30. Thus, the product 74 may be allowed to disperse into the beverage can 30 and mix with the contents 82 thereof, which mixture may then be conveniently consumed by the user through the part 66. Alternatively, the contents 82 of the can 30 may be allowed to seep through the product 74 and mix therewith as the user consumes the resulting mixture contained within the part 66. The element 78 may, if necessary or desirable, be replaced by an adhesively backed tape element (not shown) which may cover either the entire undersurface of the bottom portion 70, or merely the openings therein, and which may be discarded after removal. As further shown in FIG. 10, the sidewalls 68 are provided with an internally disposed annular recess 84 near the top of the part 66 for receiving the periperal edge of the lid portion 72. A deflectable annular skirt portion 86 bounds the recess 76 in the bottom portion 70 and extends preferably contiguiously from the sidewalls 68 to intimately engage the outer surface of the beverage can rim 28. The part 66 may thus be easily removed from the can 30 by deflecting the skirt portion 86 outwardly slightly to relieve the pressure exerted on the rim 28. A similar arrangement is shown as provided with the attachment 20 in FIG. 1.

As further shown in the drawings, the attachment 20 and the combination attachment 66 may be integrally formed from any suitable plastic material which may be rapidly and inexpensively molded to the desired shape. Furthermore, the sidewalls 22 and 68 may be relatively stiff to provide the structural support necessay to maintain the shape of the vessel while the bottom portion 24 and 70 may be of more flexible structure, as by reducing the thickness thereof, which may advantageously provide for closer conformance of the bottom portion to the surface configuration of the lid portion of the beverage can.

It will be appreciated that the above description, although relating principally to a drinking attachment for a beverage can having the usual pull-tab type opening in its lid, is similarly applicable to practically any shape and contour opening which may be provided in the usual beverage container simply by employing the principles set forth hereinabove.

The embodiments of the invention in which an exclusive property or privilege is claimed are defined as follows:

1. A combination product container and drinking attachment for a beverage can comprising: an annular cup-shaped vessel having sidewalls and a generally planar bottom portion; a lid portion wedgingly received within the interior of said sidewalls remote from said bottom portion to provide a closure for a product contained within said vessel; said bottom portion having an annular recess disposed about the periphery thereof for receiving the rim portion of a beverage can, said recess being arranged to fit tightly about such rim portion of a beverage can while permitting said vessel to rotate thereabout, said bottom portion having a slotted opening extending radially outwardly from the center of said bottom portion along a first axis to provide access to a corresponding aperture aligned therewith in such beverage can as said vessel is attached to such beverage can; a first rib portion extending about the periphery of said slotted opening adjacent the underside of said bottom portion and adapted to sealingly contact the lid of such beverage can about such beverage can aperture; a removable sealing element covering said slotted opening in said bottom portion to prevent the leakage of the contents of said vessel therefrom, which sealing element is removable to expose said slotted opening to provide access to such corresponding beverage can aperture aligned therewith as said vessel is attached to such beverage can; and a second rib portion located adjacent the underside of said bottom portion and angularly displaced from said first rib portion, said second rib portion having a peripheral contour similar to said first rib portion and arranged to provide a complete seal thereabout as said vessel is rotated through a predetermined arc atop such beverage can.

2. The combination as set forth in claim 1, said bottom portion having a pair of slits disposed in a generally cruciform arrangement for accommodating a tubular drinking element.

3. The combination as set forth in claim 1 wherein said first rib portion comprises a generally arcuate segment partially surrounding the radial center of said bottom portion and communicating with the remainder of said first rib portion.

4. The combination as defined in claim 1 wherein said first and said second rib portions comprise a common generally arcuate rib segment partially surrounding the radial center of said bottom portion, said first and said second rib portions communicating with one another at said common rib segment to provide a continuous contour comprising said first rib portion, said second rib portion, and said common rib segment.

5. The combination as defined in claim 1 wherein said vessel is constructed of plastic material.

6. The combination as defined in claim 1 wherein said sidewalls comprise an annular recess for receiving the peripheral edge of said lid portion.

7. The combination as defined in claim 1 wherein the external perimeter of said bottom portion annular recess is bounded by a deflectable skirt portion adapted to bear against the rim of a beverage can.

* * * * *